US008091732B2

(12) United States Patent
Bryson et al.

(10) Patent No.: US 8,091,732 B2
(45) Date of Patent: Jan. 10, 2012

(54) PLASTIC FOOD CONTAINER WITH LEVERAGED, CONICAL, AREA SEAL

(75) Inventors: Raymond J. Bryson, Chagrin Falls, OH (US); Michael G. Miller, Chesterfield County, VA (US)

(73) Assignee: Absolute Plastics, LLC, Wilson, NC (US)

( * ) Notice: Subject to any disclaimer, the term of this patent is extended or adjusted under 35 U.S.C. 154(b) by 1137 days.

(21) Appl. No.: 11/904,530

(22) Filed: Sep. 27, 2007

(65) Prior Publication Data

US 2009/0084805 A1 Apr. 2, 2009

(51) Int. Cl.
*B65D 41/16* (2006.01)

(52) U.S. Cl. ..... 220/792; 220/780; 220/793; 220/790

(58) Field of Classification Search ..... 220/780, 220/790, 792, 793, 781, 784
See application file for complete search history.

(56) References Cited

U.S. PATENT DOCUMENTS

| | | | | | |
|---|---|---|---|---|---|
| 3,532,244 | A * | 10/1970 | Yates, Jr. | ..... | 215/272 |
| 3,677,435 | A * | 7/1972 | Davis | ..... | 206/519 |
| 4,141,463 | A * | 2/1979 | Smith | ..... | 220/792 |
| 4,347,943 | A * | 9/1982 | Hackwell et al. | ..... | 220/792 |
| 4,380,304 | A * | 4/1983 | Anderson | ..... | 220/782 |
| 4,418,833 | A * | 12/1983 | Landis | ..... | 220/792 |
| 4,555,043 | A * | 11/1985 | Bernhardt | ..... | 220/783 |
| 4,632,272 | A * | 12/1986 | Berenfield et al. | ..... | 220/324 |
| 4,742,934 | A * | 5/1988 | Michaud et al. | ..... | 220/784 |
| 4,819,824 | A * | 4/1989 | Longbottom et al. | ..... | 220/266 |
| 4,872,586 | A * | 10/1989 | Landis | ..... | 220/781 |
| 5,377,860 | A * | 1/1995 | Littlejohn et al. | ..... | 220/790 |
| 6,032,827 | A * | 3/2000 | Zettle et al. | ..... | 220/788 |
| 6,056,138 | A | 5/2000 | Chen | | |
| 6,168,044 | B1 * | 1/2001 | Zettle et al. | ..... | 220/784 |
| 6,196,404 | B1 * | 3/2001 | Chen | ..... | 220/4.21 |
| 6,460,716 | B1 * | 10/2002 | Wong | ..... | 220/4.24 |
| 6,708,839 | B2 * | 3/2004 | Diesterbeck | ..... | 220/782 |
| 6,733,852 | B2 | 5/2004 | Littlejohn et al. | | |
| 6,910,599 | B2 * | 6/2005 | Tucker et al. | ..... | 220/793 |
| 6,923,338 | B2 * | 8/2005 | Dees et al. | ..... | 220/793 |
| 7,017,775 | B2 * | 3/2006 | Zettle et al. | ..... | 220/781 |
| 7,032,773 | B2 * | 4/2006 | Dees et al. | ..... | 220/793 |
| 7,055,712 | B2 * | 6/2006 | Tang | ..... | 220/4.21 |
| 7,055,715 | B2 * | 6/2006 | Maravich et al. | ..... | 220/792 |
| 7,063,231 | B2 * | 6/2006 | Stanos et al. | ..... | 220/793 |
| 7,097,066 | B2 * | 8/2006 | Tucker et al. | ..... | 220/780 |
| 7,243,813 | B2 * | 7/2007 | Krueger | ..... | 220/571 |
| 7,258,905 | B2 * | 8/2007 | Whitmore et al. | ..... | 428/35.7 |
| 7,261,219 | B2 * | 8/2007 | Tucker et al. | ..... | 220/793 |
| 7,357,272 | B2 * | 4/2008 | Maxwell | ..... | 220/785 |
| 7,484,639 | B2 * | 2/2009 | Maravich et al. | ..... | 220/792 |
| 7,726,483 | B2 * | 6/2010 | Ramanujam et al. | ..... | 206/508 |
| 7,866,502 | B2 * | 1/2011 | Maxwell | ..... | 220/366.1 |
| 2007/0012710 | A1 * | 1/2007 | Vovan | ..... | 220/793 |

* cited by examiner

*Primary Examiner* — Anthony Stashick
*Assistant Examiner* — Christopher McKinley
(74) *Attorney, Agent, or Firm* — Robert C. Lyne, Jr.

(57) ABSTRACT

A food container made of thin plastic sheet material comprises a bowl and a lid, each having a peripheral sealing region with a downwardly facing channel generally shaped like an inverted "U". The outward edges of the channels are lockingly engaged. The channels mate and engage to form a primary seal at a conical interface and a secondary seal at a rib. The rib may be on either the base, the lid, or both. Leverage provided by elastic forces in the lid's channel tightens the seals.

15 Claims, 3 Drawing Sheets

PLASTIC FOOD CONTAINER WITH LEVERAGED, CONICAL, AREA SEAL

CROSS-REFERENCES TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A SEQUENCE LISTING

Not applicable.

INCORPORATION-BY-REFERENCE OF MATERIAL SUBMITTED ON COMPACT DISC

Not applicable.

BACKGROUND OF THE INVENTION

1. Field of the Invention

This invention pertains to the field of thin-walled plastic food containers having a base and a lid engaging the base so as to form a peripheral seal.

2. Description of Related Art

Food containers in the above-identified field often include a base and a lid made of plastic sheet material, each having a peripheral sealing region, with a downwardly facing channel generally shaped like an inverted "U". The respective channels of the base and lid mate and engage to form a seal. Such containers often have two or more seals, which are referred to as "primary", "secondary", etc., according to their proximity to the contained product. Examples of such containers are described in Littlejohn U.S. Pat. No. 5,377,860, Chen U.S. Pat. No. 6,056,138, Tucker et al. U.S. Pat. No. 6,910,599, and Stanos et al. U.S. Pat. No. 7,063,231.

Fundamental requirements of such food containers include tightness and reliability of the seals, in order to prevent spillage and leakage of contained liquid products. Less fundamental but also important is ease of closing, opening, and reclosing the lids, since a seal that has the desired degree of mechanical tightness may be difficult to open without spilling the contents of the container. Often this is due to the suddenness of the release, coupled with the lightness and flexibility of the container. In addition to these requirements, there are the usual objectives or requirements of cost, durability, strength, appearance, etc., as is the case with nearly all consumer products.

Various features have been proposed to achieve an acceptable balance of these requirements and objectives. The above-identified Littlejohn patent discloses in FIGS. 7-10 a frustoconical lid seal area 68. The above-identified Chen patent discloses in FIG. 5 a lid locking lip 44 contacting a base sealing edge 39. The above-identified Tucker et al. U.S. patent discloses in FIGS. 17C and 17F two opposed area seals. The above-identified Stanos et al. patent discloses in FIGS. 2-4 a seal ring 36 on the horizontal surface of the U-shaped channel of the base or lid.

BRIEF SUMMARY OF THE INVENTION

According to this invention, a food container made of plastic sheet material comprises a base and a lid. The base has a peripheral sealing region with a downwardly facing channel generally shaped like an inverted "U". The inwardly inclined inner wall of the channel is frustoconical, with its inner surface lying on a conical surface having its axis at the center of the base and its apex above the base. The horizontal, transverse portion of the channel joining the legs of the "U" preferably has an upwardly projecting annular rib. The lid has a corresponding peripheral sealing region with a downwardly facing channel also generally shaped like an inverted "U". The channel is sized so as to mate and interlock with the channel of the base. The inner wall of the lid's channel is also frustoconical, with its inner surface lying on a conical surface having its axis at the center of the lid and its apex above the lid. The outer wall of the channel has inwardly extending hook portions at its lower end. When the base is filled with a product and the lid is applied, the respective channels mate and engage. In this assembly (1) the outer wall of the channel of the base lockingly engages the outer wall of the channel of the lid so as to prevent relative upward movement of the latter, (2) the conical surfaces contact each other and create a first, area seal, and (3) and the rib contacts the transverse portion of the lid's channel and creates a second seal. We believe that in this assembly the lid's channel is a first-class lever whose fulcrum is the rib, with the lever urging the inner wall of the channel of the lid upward with respect to the inner wall of the base's channel and thereby tightening the first, area seal. It is further believed that the lid's channel is also a second class lever whose fulcrum is the area seal, with the lever urging the transverse portion of the lid's channel downward against the rib. Elastic forces in the locked channel of the lid are the input forces for the levers. The levers make the seals tighter. Alternatively, the rib may be located on the lid rather than on the base, or on both the lid and the base.

DETAILED DESCRIPTION OF THE INVENTION

Containers according to the present invention may be made of various thermoplastic resins (e.g., polypropylene) by various manufacturing processes. Preferably the containers are thermoformed from extruded thermoplastic sheet of substantially uniform thickness, and are sufficiently thin, economical, and durable that they are either disposable or re-usable, at the option of the user. The bases and lids may be any desired configuration in plan view, e.g., polygonal, circular, or elliptical.

As used herein, directional terms such as "horizontal", "vertical", "up", "down", "top", and "bottom" relate to the orientation of the assembled base and lid when the base rests on a flat horizontal surface. Directional terms such as "radial", "peripheral", "inner", and "outer" relate to the central vertical axis of the base and lid in that orientation. "Cross-section" means a section in a plane including that axis. "Conical" and "frustoconical" refer to the shape of the surface of an imaginary right circular cone which is coaxial with the base or the lid. The "apex" (i.e., the vertex, point, or tip) of that surface means the apex of the cone. In a stereotypical depiction, for example, a mountain with a volcano at its top is frustoconical; the apex of its conical surface is above the rim of the crater; and the sides of the mountain are inwardly inclined. When viewed in cross section, a conical surface appears as a straight line. "Resilience" and cognate terms refer to the ability of a portion of the container to resume its original shape after being bent, while "resilient force" and "elastic force" refer to a force exerted by the portion in resuming that shape. "Rib" includes beads, fins, and similar projections of various cross-sectional shapes.

Figure 1:
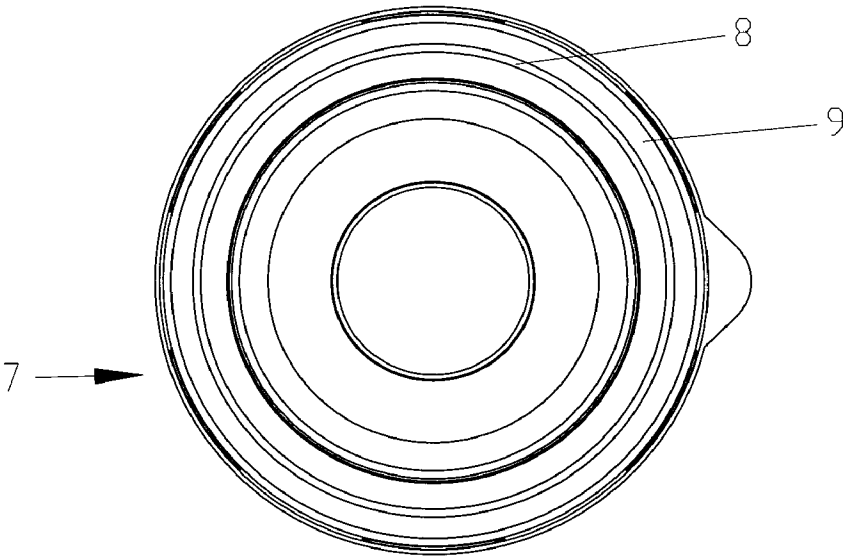
FIG. 1 is a plan view of a lid according to the invention.
Figure 2:
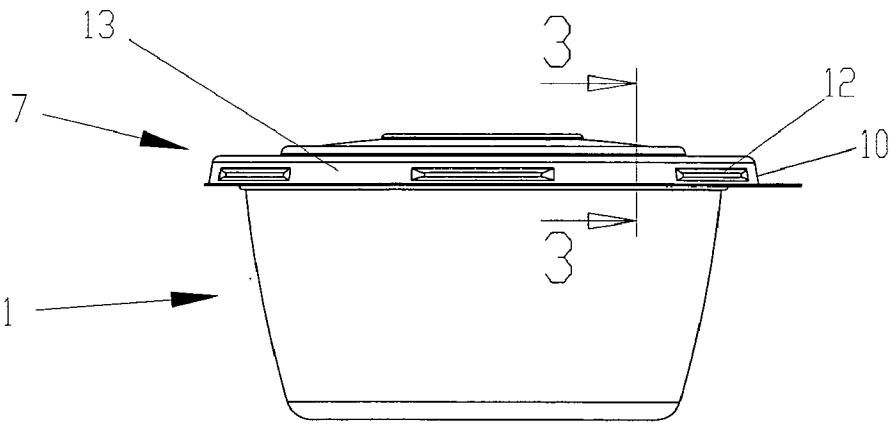
FIG. 2 is a front view of the lid shown in FIG. 1, assembled with a base according to the invention.
Figure 3:
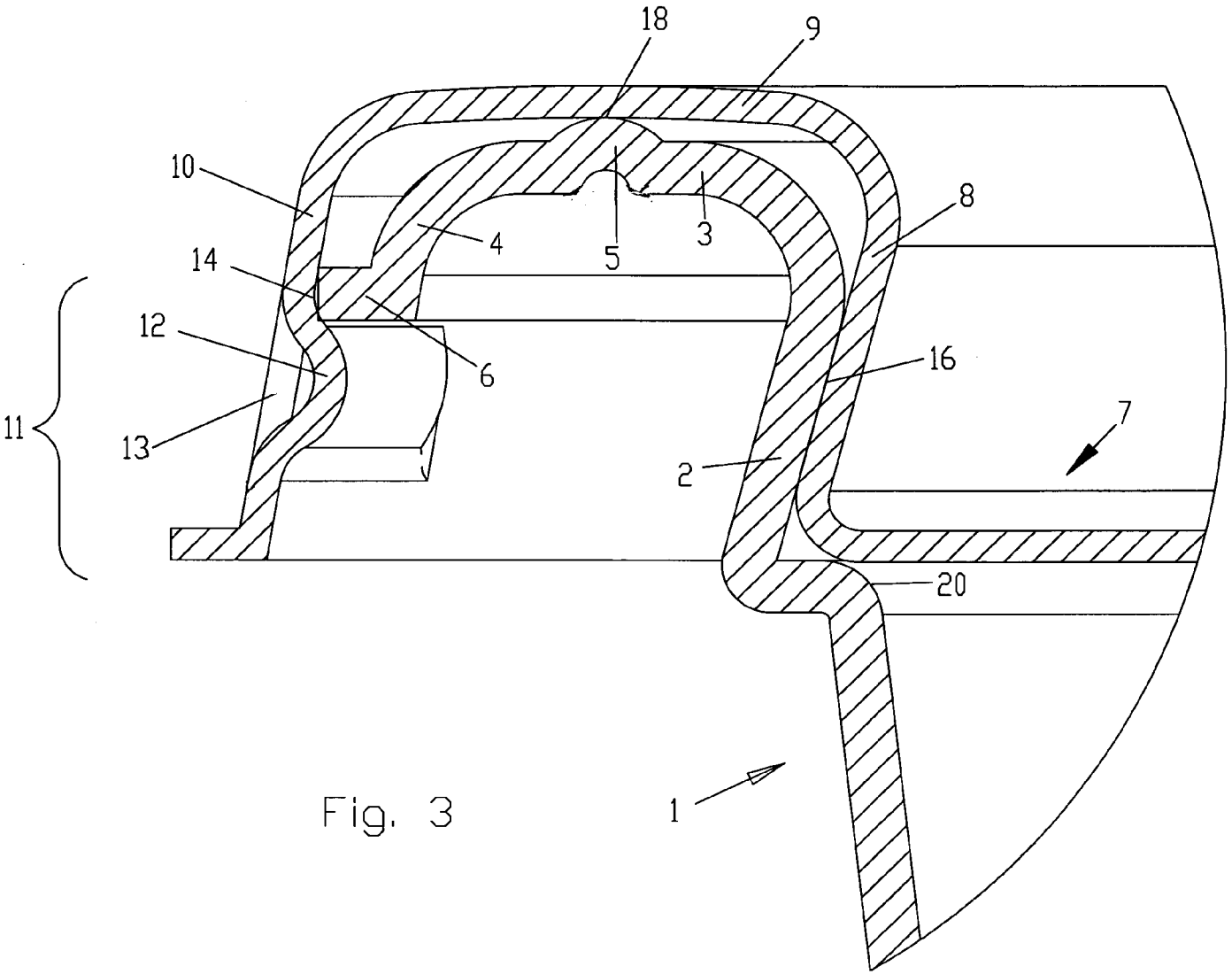
FIG. 3 is a fragmentary vertical cross-section of an assembled base and lid, taken at 3-3 in FIG. 2 in a plane containing their central vertical axis and showing their peripheral sealing region.

FIG. 1 shows lid 7. FIG. 2 shows lid 7 assembled with base 1. As best shown in FIG. 3, the peripheral sealing area of base 1 includes generally vertical but inwardly inclined inner wall 2, which forms one leg of the "U". The particular base shown is a bowl. The inwardly inclined inner surface of wall 2 lies on a surface which is conical, with the apex of the cone located above base 1. Wall 2 itself is frustoconical. Substantially horizontal channel portion 3, which extends outward from the top of wall 2, forms the transverse portion of the "U". Generally vertical wall 4, which extends downward and outward from transverse portion 3, forms the other leg of the "U". Annular rib 5 projects upwardly from transverse portion 3. Wall 4 terminates in a radially outwardly projecting terminal flange 6.

Correspondingly, lid 7 includes inwardly inclined, frustoconical wall 8, substantially horizontal transverse portion 9, and generally vertical wall 10. Wall 10 has a lower portion 11 which consists of circumferentially spaced hook portions 12 located between non-hook portions 13, as shown in FIGS. 2 and 3, and an outwardly projecting terminal flange. Hook portions 12 are elongated, radially inwardly directed indentations or undercuts in lower portion 11, with non-hook portions 13 between them. Alternatively, the entire lower portion 11 may have one continuous hook portion. That is, lower portion 11 may not have a non-hook portion 13. The upper part of each hook portion 12 forms a concave inner surface 14 that generally faces radially inward and upward, toward rib 5. Lid 7 is more resilient than base 1.

When the base and lid are assembled, the concave inner surface 14 of each hook portion 12 mechanically locks around the edge of terminal flange 6. The resiliency of lid 7 causes that concave surface to exert an inward and upward force on terminal flange 6, thereby urging the sealing regions of base 1 and lid 7 together, with rib 5 contacting the underside of transverse portion 9 of the lid, and walls 2, 8 contacting each other in an interference fit. In the embodiment shown in FIG. 1, there are six hook portions of 24° each and six non-hook portions of 35° each. In designing the lid, increasing the magnitudes of the arcs of hook portions will increase the magnitude of the total resilient force exerted on the base, while decreasing the former will decrease the latter. Different hook portions may have different arcs.

A primary seal 16 is formed where walls 2, 8 are in contact, in a frustoconical, circular band. A secondary seal 18 is formed at the circular line where rib 5 contacts the lid's horizontal transverse portion 9. Rather than have a seal inward of area seal 16, we prefer to curve or slope the upper portion of the base's side wall, as shown at 20, in order to facilitate the drainage of any liquid away from the seal area and into the container when the container is filled with a food product.

It is important that lid 7 be resilient between seal 16 and the concave surface 14. The resulting elastic forces are the input forces for making seals 16 and 18 tighter. Resiliency in the lid between the places of contact at rib 5 and concave surface 14 is especially important. At the same time, it is important that transverse lid portion 9 be sufficiently rigid that it can serve as a lever. The positive lock at concave surface 14 and the edge of terminal flange 6 is also important, since too-easy release of their engagement would unduly limit the magnitude of the elastic forces that can be applied to the seals.

We believe that our invention enables those input forces to be amplified in three different systems providing a mechanical advantage—a first-class lever (fulcrum between load and input force), a camming surface/inclined plane, and a second-class lever (load between fulcrum and input force). In each lever system, the load is the seal and the input force is the downward and slightly outward elastic force exerted on wall 10 at the mechanical lock at concave surface 14.

In the case of primary seal 16, the lever is a second-class lever whose fulcrum is rib 5. The load is a substantially vertical downward force at seal 16, which force is exerted by wall 2 on wall 8. Because the seal is conical, as previously described, this force produces a camming action that makes seal 16 tighter. Transverse portion 9 is believed to flex at rib 5 into a very shallow, upside down "V". This transverse portion is flat when the lid in the relaxed, unsealed condition. The flexure is not shown in the drawings because it is not sufficiently observable.

In the case of secondary seal 18, the lever is a second-class lever, with its fulcrum being primary seal 16. The load is the vertically upward force exerted by rib 5.

The contact between the edge of terminal flange 6 and concave surface 14 is continuous but is not intended to create a tertiary seal. It is, however, sufficient to prevent the entry of foreign material when the base and lid are assembled.

The principal purpose of the inventive structure is to provide for stronger, positive, and more reliable primary and secondary seals. We also believe, however, that it provides for easier closing, opening, and re-closing of the product-filled container, since the seals can be created and eliminated in a slightly sequential fashion, rather than simultaneously. During opening, for example, wall 10 of the lid is moved outward and upward, so that concave surface 14 disengages from the edge of terminal flange 6 and the continuous radial tension in walls 9, 10 is relaxed. This eliminates the line seal 18 and removes the leverage and pressure from area seal 16, which in turn make the elimination of the final seal, area seal 16, less sudden. Such removal, being less violent, is less likely to elevate, twist, or jerk the container so as to spill some of its contents. The same principles, we believe, apply to closing and re-closing the container, since they allow the interference creating area seal 16 to be reduced in the design of the container.

One or more circumferential relief grooves may be provided in the top of transverse lid portion 9, following generally the path of rib 5 of the base, in order to make walls 9, 10 more flexible. This might be done to facilitate the engagement and disengagement of concave surface 14 from terminal flange 6 without undesired movement between walls 2, 8 forming area seal 16. It might also be desirable to prevent the tensioned walls 9, 10 from unduly deforming the corresponding structure of the base.

Figure 4:
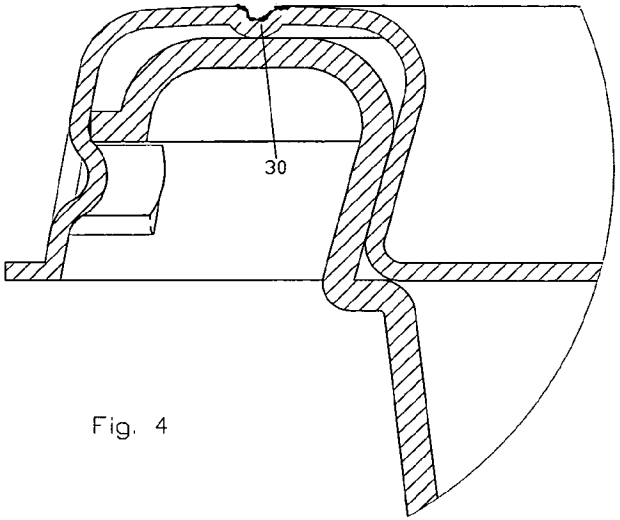
FIG. 4 is a variation of FIG. 3 in which the lid, rather than the base, has a vertically projecting rib.

FIG. 4 shows a variation of the invention in which sealing rib 30 is on the lid, rather than on the base.

Figure 5:
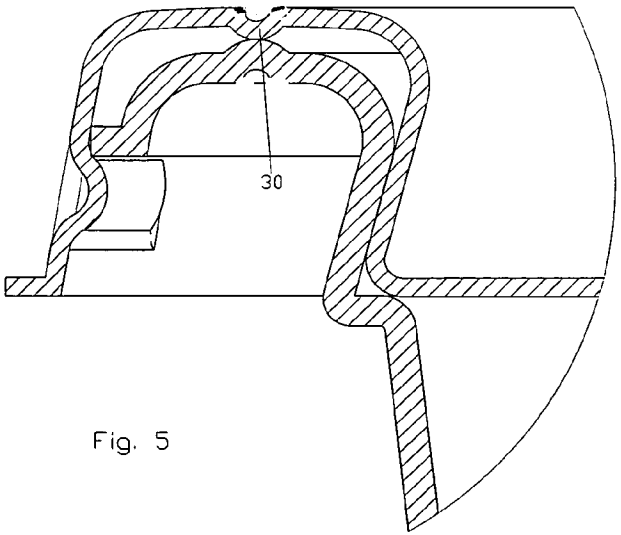
FIG. 5 is a variation of FIG. 3 in which both the lid and the base have a vertically projecting rib.

FIG. 5 shows a variation of the invention in which sealing ribs are on both the lid and the base.

The invention responds favorably to the following industry-accepted field tests, as performed on a base and lid that have not been separated before: (1) The lid cannot be easily separated from the base by a person's opposed hands grasping and pulling them apart axially; (2) the lid cannot be easily spun on the base by a person's opposed hands grasping and attempting to rotate them with respect to each other; (3) the assembled container containing a liquid is leak-resistant when turned upside down and shaken; and (4) the user can hear the lid closing on and opening from the base, without false audible signals.

Rib 5 should be sufficiently wide in the horizontal direction to prevent its deformation when the lid is urged down against it, yet sufficiently narrow to provide strong pressure at the seal, in terms of psi. A rib width in the range of 0.040 in. to 0.070 in. is preferred, with 0.0050 in. being typical. The height of rib 5 in the vertical direction should be in the range of 0.010 in. to 0.050 in., with 0.016 in. being typical. The upwardly projecting surface of rib 5 is preferably slightly convex, for convenience in its creation by thermoforming plastic sheet. The preceding portion of this paragraph applies correspondingly to the width, height, and shape of rib 30.

The thickness of the sheet material forming base 1 is typically 0.025 in. The thickness of the sheet material forming lid 7 is typically 15 degrees. The conical angle of area seal 16 is in the range of from 5 degrees to 20 degrees and is typically 15 degrees. The magnitude of the interference between walls 2, 8 is in the range of from 0.050 in. to 0.50 in and is typically 0.125 in. This is the value of one-half the difference between the maximum outer diameter of the outer surface of wall 8 and the minimum inner diameter of the inner surface of wall 2 when the base and lid are not assembled.

The drawings show the base and lid approximately to scale, except for cross-sections and spaces between them. The actual width of horizontal transverse portion 3 is approximately 0.250 in.

The following table lists the reference characters and names of features and elements used herein:

| Reference. Character | Feature or element |
|---|---|
| 1 | base |
| 2 | inner wall of channel of base |
| 3 | transverse portion of channel of base |
| 4 | outer wall of channel of base |
| 5 | rib of base |
| 6 | terminal flange of base |
| 7 | lid |
| 8 | inner wall of channel of lid |
| 9 | transverse portion of channel of lid |
| 10 | outer wall of channel of lid |
| 11 | lower portion of outer wall of channel of lid |
| 12 | hook portion |
| 13 | non-hook portion |
| 14 | concave inner surface |
| 16 | primary seal |
| 18 | secondary seal |
| 20 | curve or slope |
| 30 | rib of lid |

It will be understood that, while presently preferred embodiments of the invention have been illustrated and described, the invention is not limited thereto, but may be otherwise variously embodied within the scope of the following claims.

The invention claimed is:

1. A food container made of plastic sheet material and comprising:

(a) a base having a peripheral sealing region with a downwardly facing channel which, when viewed in cross-section, is generally shaped like an inverted "U" with a horizontal, transverse portion joining the legs of the "U", a substantial portion of the inner wall of the channel being frustoconical, inwardly inclined, and defined by an imaginary cone whose apex is located above the base; and (b) a lid having a corresponding peripheral sealing region with a downwardly facing channel generally shaped like an inverted "U" with a horizontal, transverse portion joining the legs of the "U", a substantial portion of the inner wall of the channel of the lid being frustoconical, inwardly inclined, and defined by an imaginary cone whose apex is located above the lid, the outer wall of the channel having an inwardly extending hook portion, and the lid being sized so that it will mate and interlock with the base;

(c) wherein, at least one of the transverse channel portions has a vertically projecting annular rib; and (d) wherein, when the base and lid are assembled with their U-shaped channels interlocking, (i) the frustoconical inner walls of the channels engage so that their conical surfaces are in substantial contact with each other and create a first, area seal between the base and lid, (ii) the annular rib contacts the mating transverse channel portion, creates a second seal between the base and lid, and provides substantial clearance between the transverse channel portions inwardly and outwardly adjacent the rib;

(iii) the hook portion of the channel of the lid engages the outer wall of the channel of the base so as to prevent relative upward movement of the lid; and (iv) the channel of the lid is a first class lever whose fulcrum is the rib, with the lever urging the inner wall of the channel of the lid upward with respect to the inner wall of the channel of the base and thereby tightening the first, area seal.

2. A container according to claim 1 wherein the outer wall of the channel of the lid has a plurality of inwardly extending hook portions.

3. A container according to claim 2 wherein the hook portions are radially inwardly directed indentations which are circumferentially spaced from each other.

4. A container according to claim 1 wherein, when the base and lid are assembled, the outer wall of the channel of the base terminates in a flange, and the hook portion locks under the flange.

5. A container according to claim 1 wherein, when the base and lid are assembled, the channel of the lid is also a second class lever whose fulcrum is the area seal, with the lever urging the two transverse channel portions together at the rib and thereby tightening the second seal.

6. A container according to claim 1 wherein, when the base and lid are assembled, the channel of the lid is spaced from the channel of the base between the rib and the area seal.

7. A container according to claim 1 wherein, when the base and lid are assembled, the channel of the lid, when viewed in a cross section including a hook portion, is spaced from the channel of the base between the rib and the engagement of the hook portion.

8. A container according to claim 1 wherein, when the base and lid are assembled, the channel of the lid and the channel of the base, when viewed in a cross section including a hook portion, are in contact with each other only at the area seal, the rib, and the engagement of the hook portion.

9. A container according to claim 1 wherein, when the base and lid are assembled, the lid is in continuous tension in the radial direction between the second seal and the engagement of the hook portion of the channel of the lid with the outer wall of the channel of the base.

10. A container according to claim 1 wherein the annular rib is on the transverse portion of the channel of the base, projects upwardly therefrom, and, when the base and lid are assembled, contacts the lower surface of the transverse portion of the channel of the lid to create the seal.

11. A container according to claim 1 wherein the annular rib is on the transverse portion of the channel of the lid, projects downwardly therefrom, and, when the base and lid are assembled, contacts the upper surface of the transverse portion of the channel of the base to create the seal.

12. A container according to claim 1 wherein the transverse portion of the channel of the base has an annular rib projecting upwardly therefrom, the transverse portion of the channel of the lid has an annular rib projecting downwardly therefrom, and, when the base and lid are assembled, the two annular ribs contact each other to create the seal.

13. A container according to claim 1 wherein major portions of the inner walls of the channels of the base and lid are frustoconical and inwardly inclined.

14. An assembled container according to claim 9 wherein the hook portion may be disengaged from the outer wall of the channel of the base, thereby releasing the tension in the lid, before the disengagement of the frustoconical inner walls at the first seal.

15. An assembled container according to claim 9 wherein the hook portion may be disengaged from the outer wall of the channel of the base, thereby releasing the tension in the lid, and then, as the next step, the frustoconical inner walls may be separated so as to eliminate the area seal.

* * * * *